United States Patent [19]

Soong

[11] 4,315,589

[45] Feb. 16, 1982

[54] STAPLER APPARATUS

[75] Inventor: Tsai C. Soong, Penfield, N.Y.

[73] Assignee: Xerox Corporation, Stamford, Conn.

[21] Appl. No.: 80,626

[22] Filed: Oct. 1, 1979

[51] Int. Cl.[3] ..... B25C 5/02

[52] U.S. Cl. ..... 227/155; 227/120

[58] Field of Search ..... 227/120, 155

[56] References Cited

U.S. PATENT DOCUMENTS

| | | | |
|---|---|---|---|
| 389,661 | 9/1888 | Mandel et al. | 227/155 X |
| 1,956,174 | 4/1934 | Maynard | 227/155 |
| 2,218,934 | 10/1940 | Germain | 227/155 X |
| 3,703,757 | 11/1972 | Backus | 227/155 X |
| 4,194,666 | 3/1980 | Spehrley, Jr. et al. | 227/155 |

FOREIGN PATENT DOCUMENTS

| | | | |
|---|---|---|---|
| 1011398 | 7/1957 | Fed. Rep. of Germany | 227/155 |
| 1021330 | 12/1957 | Fed. Rep. of Germany | 227/155 |

*Primary Examiner*—Paul A. Bell

*Attorney, Agent, or Firm*—Bernard A. Chiama

[57] ABSTRACT

A stapler apparatus having an improved anvil to which staples are applied during a driving operation by a driver member for the apparatus. The anvil is formed with a depression or opening between the clinching grooves and is of size to include the adjacent ends of the grooves. The depression or opening assists in controlling the bonding of the legs of the staple during a stapling operation to prevent re-entry or re-penetration of the legs into a deck of sheets being stapled.

5 Claims, 8 Drawing Figures

STAPLER APPARATUS

This invention relates to improvements in fastener applying apparatus for attaching sheets of paper. The present invention is particularly applicable to stapling devices, finishers and the like which are associated with copying machines having a finishing assembly which receives finished copy sheets in collated sets, are jogged and then stapled or stitched for use by an operator.

In conventional copy machines which employ staplers or finishing apparatus, problems have arisen when attempts are made to utilize the stapler or fixing device for copy sets which range from a two sheet set up to sets which include 30 or more sheets of paper. In commercial machines having stapling devices, use is made of various sizes of staples wherein staples with long legs are used for sets having a relatively large number of copy sheets, and short-legged staples are utilized for the lower range of the number of copy sheets. In between these two extremes of the number of sheets there may be other sizes of staples utilized. In these situations, the operator must either remove all of the staples from one or more of the staplers associated with the copying machine and insert quantities of staples of the size more compatible to the number of sheets in the set for which he is preparing to produce. This entails removing perhaps thousands of staples from each of the stapling devices associated with the machine and reinserting great quantities of the desired staple.

The alternative to incorporating procedures and apparatus for effecting staple size changes is to neglect or refrain making changes in staple sizes. In this situation, the machine utilizes a standard size staple, one having relatively long legs for the maximum number of sheets in a set the copy machine is adapted to collate. When the copy machine is programmed then to produce sets containing 2, 3, or 4 sheets and use is maintained for the long legged staples, the staples will re-penetrate such set during a stapling operation and the legs will protrude outwardly from the top sheet of the set thus presenting a very unsightly stapled set. In addition, with the two relatively sharp tips of the staple protruding through the top sheet there is great likelihood the recipient of a set will puncture the skin of his fingers in handling the set. Furthermore, when a number of sets having this condition of said staples are piled one upon the other such as in a file folder, the corner of the set having the staples becomes rather bulky and more than likely may even damage the edges of other papers in the file.

Another alternative, of course, is to utilize a relatively sophisticated active clinching device along with the stapler. These devices add considerable cost and complexity to a stapling apparatus and increases the incidences of malfunction.

Therefore, the principal object of the present invention is to improve stapling capability of a stapler device in handling thin sets of sheets, say on the order of two or three sheets, as well as thick sets, on the order of 20 or more sheets.

Another object of the invention is to improve the range of applicability of a stapling device without increasing its cost of manufacture of the necessity of providing sophisticated engineering techniques in developing an improvement to the device.

Further objects and advantages of the present invention are set forth or will appear from the following specification which describes a preferred form of the invention by way of example and is illustrated by the accompanying drawings wherein.

Figure 8:
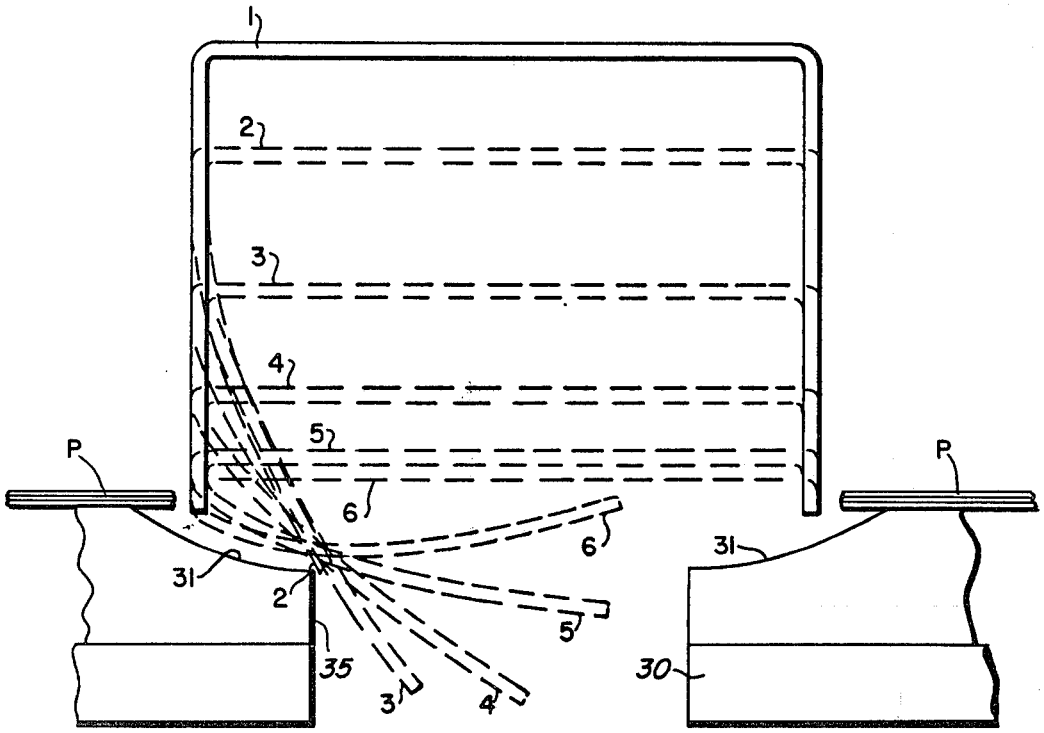

FIGS. *7a–7f* are schematic illustrations of a staple being operated upon during a stapling operation in a conventional stapler apparatus; and FIG. 8 is an enlarged partial cross-sectional view of the anvil member of the present invention showing various stages of movement of a staple therethrough.

In the accompanying specification and accompanying drawings, the stapler apparatus disclosed for which the present invention is embodied is a hand operated implement such as an ordinary commercial desk-type stapler. It is to be understood that this utilization is only for exemplary purposes and that the stapling apparatus of the present invention is also applicable to a sophisticated finishing stapler head utilized in conjunction with a copying machine.

The disclosed stapling apparatus also is shown as applicable to U-shaped staples which are commercially available in the market and which assume various sizes which generally differ in the length of the legs of the staples. The present invention is also applicable to any other configuration of a staple other than a U-shaped form; such, for example, for use with ribbon form of packaging for staples. In this latter form the staples are not bent into a U-shape but rather are presented in a stapling apparatus in straight elongated configuration and are tied together along their mid-portions by glue or very thin frangible ribbon material.

In general, the stapling apparatus to which the present invention is embodied comprises a relatively flat, rectangular base 10, a staple magazine 11 pivoted above the rearward end of the base member and a driver operated lever 12 pivoted upon a yoke, secured upon the base member by way of a pivot pin 13 which also serves to pivot the magazine member relative to the driver member. A suitable hand-rest 15 is secured to the driver member at the forward end thereof.

While the invention is herein described and illustrated as embodied in a stapling device of the generally conventional, manual operable type, such as the illustrated desk stapler, it is to be understood that the present invention is adapted for use with other forms of stapling and stitching machines. For example, the present invention may be applied to stapling devices which are power operated, the power being generated by an electromechanical solenoid, or by pneumatic or hydraulic power generating devices or by mechanical devices which are arranged to effect the clinching, clamping and fastening of a plurality of sheets of paper.

The magazine 11 is preferably constructed of sheet metal formed into a trough-shaped, elongated channel with upstanding sides 16 and 17 and closed at its forward end by a vertical wall 18 which limits the removal of staples S from the magazine when contained therein. At this forward end of the magazine, a cutaway is formed as an open guideway for the egress of staples when driven out of the stapler device.

A stick of staples S is received in the magazine in the conventional manner and a slipper 20 is also provided in the magazine or urging the stick S forward against the stop 18 to maintain the outermost staple in alignment with the guideway 19. The slipper 20 is slidably mounted in the magazine and is urged forward therealong by a helical spring 21 held in compression between the adjacent end of the slipper and the rear wall (not shown) of the magazine.

The driver lever 12 may also be constructed of sheet metal and formed to provide depending sides 23 and 24 which slidably retain the end walls 16, 17 respectively, for the magazine 11. A substantially vertical blade-like element 25 secured to the forward end of the driver member forms the driver for the stapling apparatus and is slidable in the guideway 19 at the adjacent forward end of the magazine 11. In this conventional construction of the stapler device already described, initial downward rotation or pivoting of the driver member 12 which carries the magazine 11 therewith, downward movement of the magazine is eventually arrested when the magazine engages the stapler anvil on the base 10 (to be described hereinafter) and continued movement of the driver member 12 relative to the now fixed magazine causes the driver 25 to contact the outermost staple and drive the same through the guideway 19 as into operative engagement with an anvil. Release of the driver member 12 causes the initial reverse rotation of the driver member together with magazine 11 and thereafter the continued rotation of the driver member alone. The aforegoing description of the operation of the stapler apparatus is conventional and the described apparatus or any other similar apparatus may be utilized as an environment for the present invention.

Figure 1:
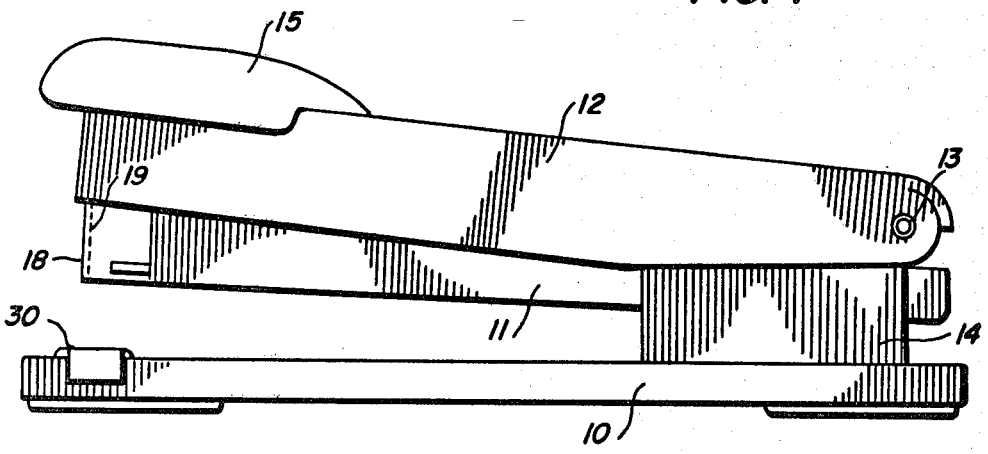
FIG. 1 is a side elevational view of a manually operable stapling apparatus embodying the principles of the present invention.
Figure 2:
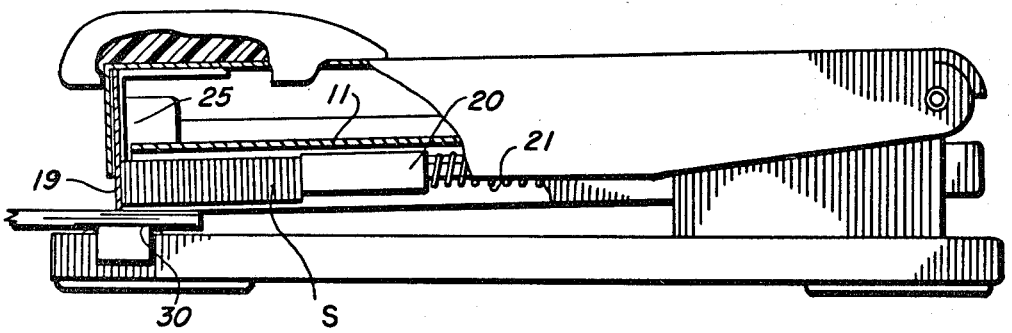
FIG. 2 is a side elevational view of the apparatus in FIG. 1 showing the operating lever and staple magazine in vertical alignment and in cooperation with the base member of the stapling apparatus.
Figure 3:
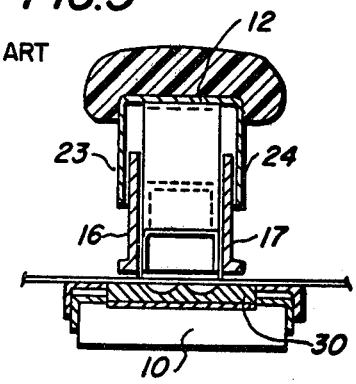
FIG. 3 PRIOR ART
FIG. 3 is an end view of the apparatus of FIGS. 1 and 2.
Figure 4:
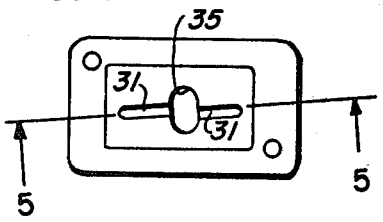
FIG. 4 is a plan view of the anvil member utilized in the apparatus of FIG. 1 showing specific details therein.
Figure 5:
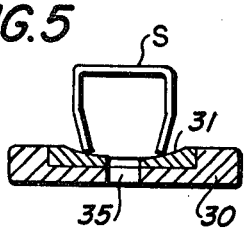
FIG. 5 is a cross-sectional view of the anvil member taken along the line 5—5 of FIG. 4.
Figure 6:
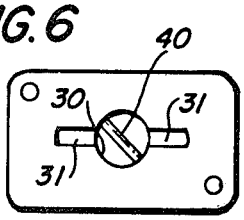
FIG. 6 is a plan view of another configuration of the anvil member embodying the present invention.
Figure 7:
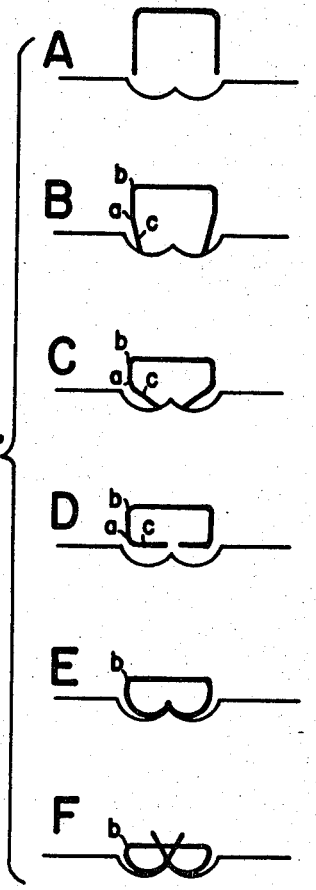
PRIOR ART FIG. 7

As shown in FIGS. 1 and 4, the base 10 supports a clinching anvil 30 at its forward end, the anvil being formed with clinching grooves 31 of a shape and disposition for bending the legs of a staple inwardly. As shown in FIG. 4, the anvil grooves 31 have their longitudinal axis in parallel but at an angle relative to the bridge portion of a staple in order to prevent the tips of the legs of a staple from interferring with each other during stapling operation. As shown in FIGS. 4 and 5, in accordance with the present invention, anvil 30 is formed with an opening 35 which, for illustration purposes only, projects entirely through the anvil. The opening 35 is of a size to include adjacent ends of the clinching grooves 31, or which would be portions of the clinching grooves if the opening was not formed as in conventional anvils. While illustrated as having an oval shape, the opening 35 may be of square shape, circular, rectangular, or any other shape which will provide an edge which is approximately normal to the longitudinal axis of each of the grooves 31. Since the illustrated grooves are outset relative to each other, because of their angular orientation, the opening 35 will assume an oval shape in order to provide the normal edge for each of the grooves. While the illustrated opening 35 is shown as extending completely through the anvil as will be made apparent in the description hereinafter, the opening may assume the shape of a depression and would depend solely upon the length of the legs of a staple and the thickness of the set of papers being stapled.

In another configuration, the grooves in the anvil may be symmetric to the center and the impinging of the ends of the two legs of the staple is avoided by placing, as an integral part of the depression, or hole, a thin and rigid metal piece 40 inclined with respect to the groove, so that the ends of the staple are guided by the metal piece 40 and head-on collision is avoided.

In commercial stapling machines utilizing conventional clinching anvils, that is, anvils that are not preformed with openings or depressions similar to the opening 30 in accordance with the present invention, the use of staples having relatively long legs for stapling sets of paper having only a few sheets such as 2, 3, or 4 sheets, re-penetration of the legs of the staple back through the top sheet of the set being stapled occurs. To avoid re-penetration, the operator must remove the long legged staples in the stapling machine being utilized and add staples having short legs which may accommodate the low number of sheets being stapled without re-entry of the legs tips into the set. If later, the paper sets have a number of sheets say, on the order of 25 or more sheets, the operator must remove the short-legged staples from the stapling apparatus and resupply the same with staples having long legs.

When the legs of the staples are pushed against the clinching grooves in the conventional anvil, deformation depends upon, besides the curvature of the grooves, the length of the legs measured from its tip to a support point along the leg. For a standard staple, when there are only 2, 3, or 4 sheets being stapled, the support point is the joint of the leg with the bridge of the staple. This length, is relatively short and the tip portion of the leg begins to experience plastic deformation immediately upon the contact with the curve of the clinching grooves. This is also true for a long legged staple after the long leg penetrates a thick set of papers. In this situation, the paper set supports the leg and plastic deformation begins in a region relatively close to the tip of the leg. In both cases the anvil serves as a forming dye in bending the legs of the staple. The leg is deformed plastically in a continuous manner and curled upward to press against the bottom surface of the paper set. More often, the tip of the legs do not even contact the middle portion of the clinching grooves.

However, if the legs of the staple are long and there are only 2, 3 or 4 sheets being stapled, the support point of the leg is located far from the tip of the leg so that severe bending stress only appears at a considerable distance away from the tips. Hence, between the tips and the stress points, the leg remains almost straight and permanent deformation begins only after that point. As the staple continues its downward motion, the tips of the legs continue to slide toward the center of the anvil along the bottom of the clinching grooves. This motion increases the moment arm from the tips to the stress points until a plastic hinge appears and the leg suddenly collapses. Further downward motion of the legs will produce more permanent deformation in the legs while the straight portions of the legs may remain straight because the effective contact with the anvil may have moved farther back from the tips. After piercing the 2, 3, or 4 sheet set when the stapling operation is completed, the large bent is formed and a straight portion of each of the legs points upwardly. This being the case, the presence of the middle portion of the anvil or rather that portion which is present between the clinching grooves plays a crucial role for a long-legged staple in re-penetrating a 2, 3, or 4 sheet paper deck.

In FIGS. *7a* to *7f* there is shown various stages of a deformation of a staple during a stapling operation utilizing a conventional anvil. In FIG. *7a*, the staple has effectively penetrated a 2, 3 or 4 sheet set and the tips "c" are ready to engage the bottoms of the clinching grooves 31. In FIG. *7b*, the legs of the staple experience a plastic yield at point "a" and become slightly deformed from "a" to "b" with a portion "a" to "c" remaining straight. In FIG. *7c*, with further lowering of the staple, a portion of the legs from "a" to "c" remains fairly straight but "a" to "b" has to bend more as tips "c" continue to climb toward the center portion of the anvil. In FIG. *7d*, it is noted that further lowering of the staple provides a greater angle change at the point "b" whereat the yield hinge is formed while the straight portion between points "a" and "c" remain straight. In FIG. *7e*, it is noted that the shape of each of the legs conforms to the shape of the clinching groove while the portion of the legs from "a" to "c" remains straight. In FIG. *7f*, the tips "c" of each of the legs re-enters the paper set to cause re-penetration which is entirely due to the angle decrease at points "b" with the portion between "a" and "c" remaining straight.

In the plastic deformation of the staple as illustrated in FIGS. *7a–7f*, it is noted that at stage *7b*, the bent at points "a" is small and that at stage *7d* the angle "cab" is relatively large. Final re-penetration, as illustrated in *7f*, is unavoidable due to the advance stage of bending of FIG. *7d* and perhaps even at stage *7c*.

The present invention serves as a remedy to limit the increment of plastic deformation of the legs at the stage illustrated in FIG. *7b*. By removing the material in the anvil near its zero slope point in the clinching grooves, as shown in FIG. 5, the legs of the staple can extend freely thereafter. In FIG. 8, an anvil is shown in accordance with the present invention as being operative relative to the movement sequences of the staple being applied thereto. For purposes of simplicity, only one leg of a staple and its six superimposed positions of movement are illustrated and will be described. In position 1, the staple has been driven out of the magazine 11 by the driver 25 to a position wherein the tip of the staple leg has penetrated the set of papers P comprising 2–4 sheets of paper. In this illustration and description, the staple has relatively long legs usable for sets comprising 25 or more sheets and, as will be described below, is usable for sets containing 2, 3, or 4 sheets without producing re-penetration.

In position 1, the staple leg has penetrated the set P and is about to engage the bottoms of the groove 31. As the staple leg is removed to position 2, the tip of the leg has reached the edge E of the opening 35. Further movement of the staple downwardly allows the leg to extend into the opening without interference. In position 4, the tip of the leg extends further into the opening without causing too great an increase in the angle between the two portions of the leg. At position 5, the angle between the bridge of the staple and the leg has increased but there has been no change in the angle between the tip of the leg and its juncture with the bridge. At position 6, which denotes completion of the stapling operation, the tip of the leg is in contact with the bottom sheet of the set P and, it is noted, that this tip has not penetrated the set. The shape of the staple then when in position 6 is indicative of the form of a long legged staple after the completion of a stapling operation of a set of papers having only 2, 3, or 4 sheets of paper. It will be noted that there is no re-entry or re-penetration of the legs of the staple up through the sheets.

From the foregoing, it will be appreciated that the present invention is an improvement of conventional staplers which will permit the use of a single sized staple for stapling sets of paper sheets ranging between 2, 3, and 4 sheets per set to sets containing 25 or more sheets. It will also be appreciated that this use of a single staple for a relatively wide range of thicknesses of paper sets to-be-stapled is readily available at very minimal cost both in parts and in engineering effort in modifying conventional stapling apparatus.

What is claimed is:

1. In a stapler apparatus of the passive clincher type having a base member and a staple magazine movably related toward each other during a stapling operation, means cooperating with the members for forming said members in opposite directions, the magazine member being provided at an end thereof with staple dispensing means, the base member being provided at an end thereof with an anvil member, the anvil member and the staple dispensing means being adapted to cooperate to permit individual ones of the staples to be dispensed toward and against the anvil member to perform a stapling operation when the base and magazine member are moved toward each other, and wherein the anvil member is formed with clinching grooves in generally longitudinal aligment or slightly offset for bending the legs of a staple toward each other during a stapling operation, the improvement wherein:

the anvil member is formed with a depressed area between and including the adjacent ends of the grooves, said depressed area being defined by an edge extending across each of the respective grooves said edges being positioned so that the tips of the legs of staples reach the same during staple clinching operating and extending into the opening during continuing passive clinching operation for controlling the angular bending of the legs.

2. The stapler apparatus of claim 1 wherein said depressed area is in the form of an opening through the anvil member.

3. The stapler apparatus of claim 2 wherein said opening is generally of circular configuration.

4. In a stapler apparaus of the passive clincher type having a base member and a staple magazine member movably related toward each other during a stapling operation, means cooperating with the members for forming said members in opposite directions, the magazine member being provided at an end thereof with staple dispensing means, the base member being provided at an end thereof with an anvil member, the anvil member and the staple dispensing means being adapted to cooperate to permit individual ones of the staples to be dispensed toward and against the anvil member to perform a stapling operation when the base and magazine member are moved toward each other; the improvement wherein:

the anvil member is formed with a clinching depressing coopeable with each of the legs of a staple respectively for producing bending of the respective legs toward each other, each of said depressions having an edge in the direction of movement of the tips of said legs, said edges being positioned so that the tips of the legs of staples reach the same during staple clinching operation and extending into the opening during continuing passive clinching operation across each of the respective grooves said edges being positioned so that the tips of the legs of staples reach the same during staple clinching operating and extending into the opening during continuing passive clinching operation for controlling the angular bending of the legs.

5. In a stapler apparaus of the passive clincher type having a base member and a staple magazine movably related toward each other during a stapling operation, means cooperating with the members for forming said members in opposite directions, the magazine member being provided at an end thereof with staple dispensing means, the base member being provided at an end thereof with an anvil member, the anvil member and the staple dispensing means being adapted to cooperate to permit individual ones of the staples to be dispensed toward and against the anvil member to perform a stapling operation when the base and magazine member are moved toward each other, and wherein the anvil member is formed with at least one clinching groove into which the tip of a leg of a staple is directed during a stapling operation, for bending the leg toward the other leg of the staple, the improvement wherein:

the at least one groove in the anvil member is formed with an edge positioned generally transversely thereof and in the direction of the bending of the leg said edge being positioned so that the tip of the leg of a staple reaches the same during clinching operating and extending beyond the edge during continuing passive clinching operation for controlling the angular bending thereof.

* * * * *

UNITED STATES PATENT AND TRADEMARK OFFICE

CERTIFICATE OF CORRECTION

PATENT NO. : 4,315,589

DATED : February 16, 1982

INVENTOR(S) : Tsai C. Soong

It is certified that error appears in the above-identified patent and that said Letters Patent are hereby corrected as shown below:

Claim 4:
Col. 7, lines 3-6, please delete:

"said edges being positioned so that the tips of the legs of staples reach the same during staple clinching operating and extending into the opening during continuing passive clinching operation"

Signed and Sealed this

*Twenty-fifth* Day of *May 1982*

[SEAL]

*Attest:*

GERALD J. MOSSINGHOFF

*Attesting Officer*

*Commissioner of Patents and Trademarks*